US010945481B2

(12) United States Patent
Kennedy

(10) Patent No.: US 10,945,481 B2
(45) Date of Patent: Mar. 16, 2021

(54) ATTACHABLE FAN DEVICE

(71) Applicant: Bobby Joe Kennedy, Dothan, AL (US)

(72) Inventor: Bobby Joe Kennedy, Dothan, AL (US)

( * ) Notice: Subject to any disclaimer, the term of this patent is extended or adjusted under 35 U.S.C. 154(b) by 0 days.

(21) Appl. No.: 16/896,620

(22) Filed: Jun. 9, 2020

(65) Prior Publication Data

US 2020/0300256 A1 Sep. 24, 2020

Related U.S. Application Data

(63) Continuation-in-part of application No. 15/951,479, filed on Apr. 12, 2018.

(51) Int. Cl.

| | |
|---|---|
| ***A42B 1/24*** | (2006.01) |
| ***A24B 1/00*** | (2006.01) |
| ***F04D 25/16*** | (2006.01) |
| ***F04D 25/06*** | (2006.01) |
| ***F04D 29/64*** | (2006.01) |
| ***F04D 29/52*** | (2006.01) |
| ***A42B 1/008*** | (2021.01) |

(52) U.S. Cl.

CPC ..... *A42B 1/24* (2013.01); *A42B 1/008* (2013.01); *F04D 25/0673* (2013.01); *F04D 25/166* (2013.01); *F04D 29/522* (2013.01); *F04D 29/646* (2013.01); *F05B 2240/91* (2013.01)

(58) Field of Classification Search

CPC ..... A42B 1/008; A42B 1/24; A42B 1/242; A42B 3/0406; A62B 18/003; F24F 7/007

See application file for complete search history.

(56) References Cited

U.S. PATENT DOCUMENTS

| | | | | |
|---|---|---|---|---|
| 4,672,968 | A * | 6/1987 | Lenox | A41D 13/1209 2/171.3 |
| 6,032,291 | A * | 3/2000 | Asenguah | A42B 1/008 2/171.3 |
| 9,631,804 | B1 * | 4/2017 | Glenn | F21V 21/0885 |
| 9,844,239 | B2 * | 12/2017 | Plain | F04D 25/084 |
| 2009/0031475 | A1 * | 2/2009 | Ochoa | A42B 1/244 2/171.3 |
| 2013/0118506 | A1 * | 5/2013 | Osipov | F24F 9/00 128/858 |
| 2015/0143612 | A1 * | 5/2015 | Noble | A42B 1/008 2/171.3 |

* cited by examiner

*Primary Examiner* — Ryan A Reis
(74) *Attorney, Agent, or Firm* — Adrienne Love

(57) ABSTRACT

A fan device comprises a main body connected at a first axis and second axis to a first housing and second housing, respectively. The interior of first housing and second housing include a fan assembly. Fan assembly is operated by a switch on main body. Slats along the face of first and second housing allow airflow created by fan assembly to pass out of first and second housing. The direction of airflow can be adjusted by pivoting first housing and second housing downward from the horizontal plane upon which main body lies.

4 Claims, 9 Drawing Sheets

ATTACHABLE FAN DEVICE

CROSS-REFERENCES TO RELATED APPLICATIONS

This non-provisional patent application is a continuation-in-part of application Ser. No. 15/951,479. The prior application listed the same inventors as the present application

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of devices made for providing airflow to a user. More specifically, the invention comprises a fan with clips capable of attaching to an object.

2. Description of the Related Art

Fans have been used for centuries to provide airflow to users. The airflow caused by a fan increases evaporation which has a cooling effect on human skin. Airflow also acts to push air particles away from the face to breathe cleaner air. Fans come in many shapes and sizes, from large overhead fixed fans to small portable fans. Additionally, fans can be electric, battery operated or human operated (such as a handheld paper fan).

Often, small portable fans are useful in venues where there is not a convenient power source and a large fan is not practicable. However, prior art portable fans typically require the user to hold the fan and if not, they are difficult to aim in the desired direction at the desired distance to a user.

Therefore, what is needed is a small portable fan which allows for attachment to small objects and has the ability to make pivotal adjustments. It is also desirable that the fan is capable of being positioned to provide airflow downward onto a user's face from a set distance. The present invention achieves this objective, as well as others that are explained in the following description.

BRIEF SUMMARY OF THE INVENTION

The present fan device comprises a main body having a first receiving edge and a second receiving edge to which a first housing and a second housing are pivotally connected respectively. The pivotal connection occurs along a first axis and second axis and allows first housing and second housing to adjust in a downward direction, angularly displaced from the horizontal plane of the main body, by approximately 90-degrees. The interior of first housing and second housing include a fan assembly that generates airflow. The airflow escapes the interior of first and second housing through a series of slats located on the face of first and second housing. By adjusting the angle of the first and second housing, a user can also adjust the direction of the airflow itself. A switch on main housing connects to a power source and fan assembly and can be used to turn on or off fan device. A LED light can optionally be included on fan device to provide light to a user. LED is operated by a button on main housing.

At least two clips are located on the top of main housing to connect to an object, so that the fan device can be used hands-free. When connected to an object, a user can adjust first and second housing by simply pivoting each housing into the desired position. First and second housing will stay in place once adjusted to the desired position.

REFERENCE NUMERALS IN THE DRAWINGS

Figure 1:
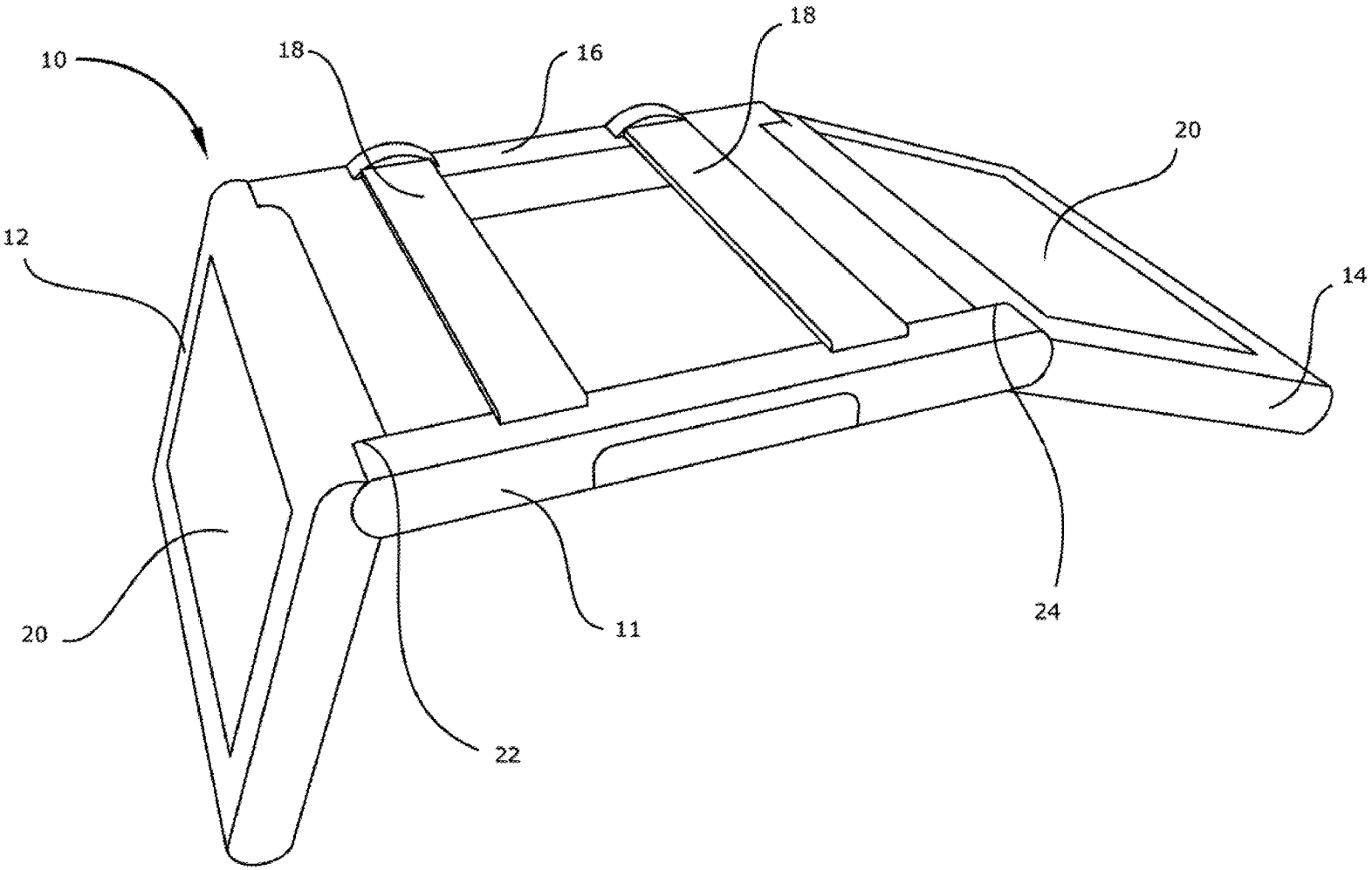
FIG. 1 is a perspective view, showing the present invention.

10 fan device
11 front
12 first housing
14 second housing
16 main housing
18 clips
20 hook and loop fasteners
22 first axis
24 second axis
26 switch
28 slats
30 port
32 button
34 slide tabs
36 light
38 fan assembly
40 ball cap
42 car visor

DETAILED DESCRIPTION OF THE INVENTION

FIG. 1 illustrates fan device 10 in one embodiment. Fan device 10 has a first housing 12, second housing 14 and main housing 16. Main housing 16, having a front edge 11, a first receiving edge (at first axis 22) and a second receiving edge (at second axis 24) is pivotally connected to first housing 12 at first axis 22 (along first receiving edge) and second housing 14 at second axis 24 (along second receiving edge). First and second housing 12, 14 pivot downward from the horizontal plane aligned with main housing 16. Although the mechanics of first axis 22 and second axis 24 are not shown, the reader will appreciate that first housing 12 and second housing 14 are able to adjust to any angular position that is desired and stay set in that position (similar to the adjustment mechanism in a rear view mirror in a vehicle). Fan device 10 has optional hook and loop fasteners 20 attached to the top of first and second housing 12, 14. Hook and loop fasteners 20 can be used to create a more secure connection between fan device 10 and an object (not shown). In one embodiment, main housing 16 of fan device 10 includes two clips 18, which serve as the primary attachment mechanism to attach fan device 10 to various objects (not shown). Clips 18 can be covered by cloth.

Figure 2:
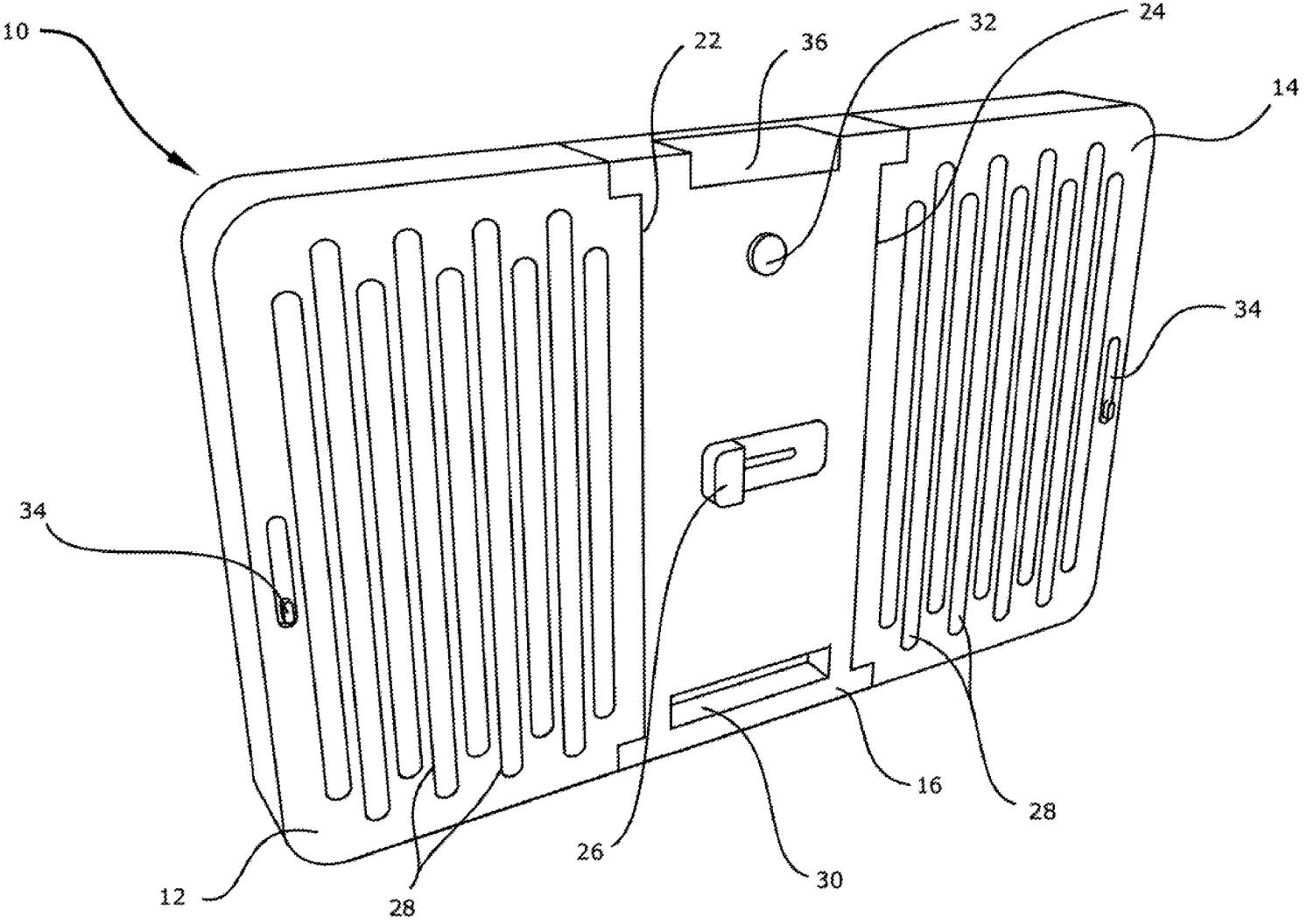
FIG. 2 is a perspective view, showing the present invention.

The underside of fan device 10 is shown in FIG. 2. The reader will appreciate that the underside of fan device 10 is the part of the device most frequently facing user and therefore is also referred to as the "face" of device 10 herein. Thus, the face of first housing 12, second housing 14 and main housing 16 is the underside of fan device 10. First housing 12 and second housing 14 include long slats 28 across their face. Slats 28 allow airflow to flow out of the interior of first housing 12 and second housing 14. One embodiment of slats 28 is shown, however, any number, shape or size of slats 28 can be utilized on housings 12, 14. Additionally, first and second housing 12, 14 include optional slide tabs 34 which allow the user to adjust the air flow by opening or closing slats 28.

In one embodiment, main housing 16 includes switch 26, port 30 and button 32. Switch 26 is preferably a slide switch that can turn on and adjust fan speeds. Port 30 is preferably a micro-USB (Universal Serial Bus) charging port that is capable of accepting a micro-USB cord to charge fan device 10. Fan device 10 should have a battery capable of operating fan device 10 for at least 5-6 hours prior to requiring charging. Button 32 operates lights on fan device 10 controls, such as slide switch 26, which assist user in operating device 10 in low light environments. Additionally, device 10 can optionally include a small light 36, preferably a LED light, as illustrated.

Figure 3:
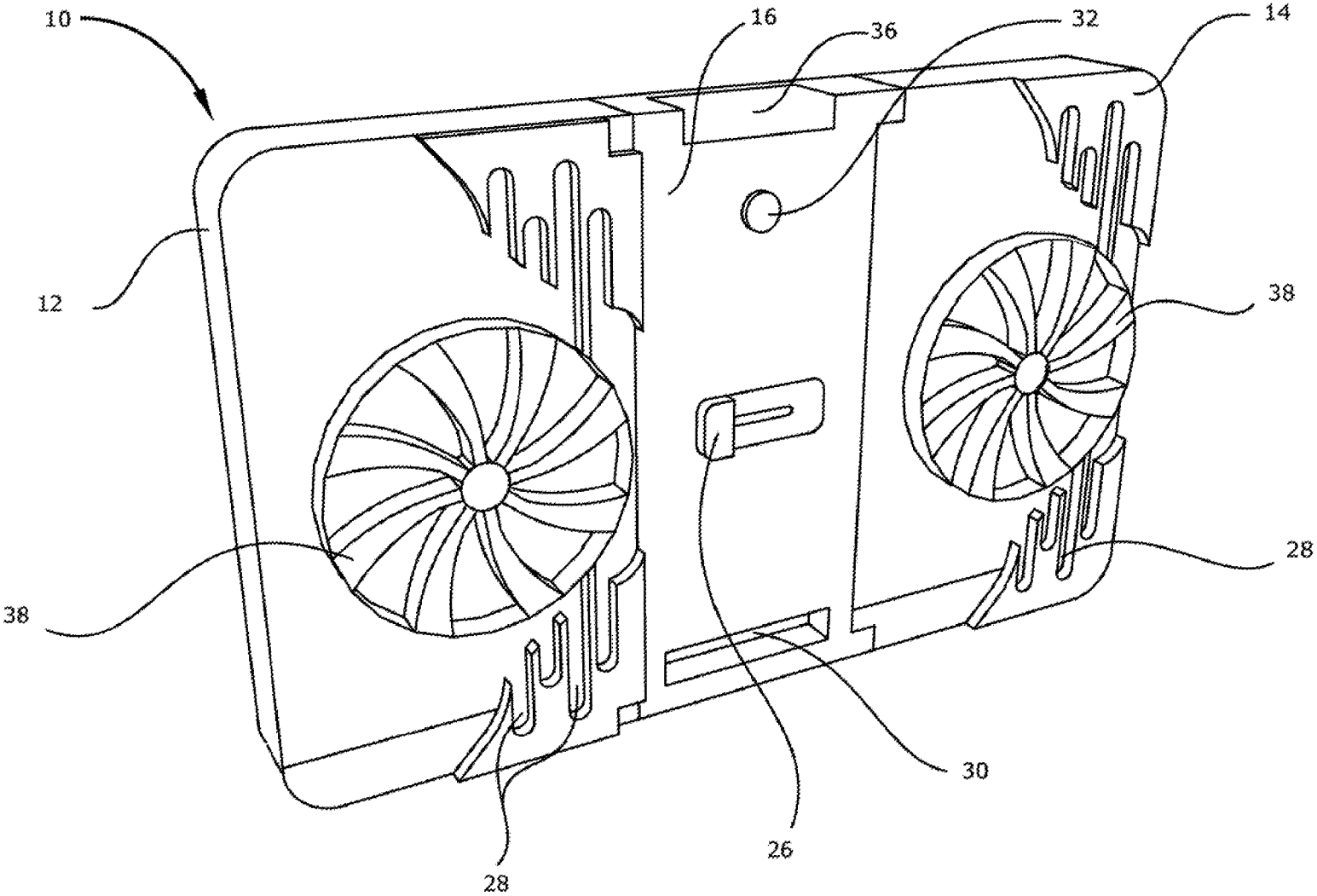
FIG. 3 is cut away view, showing the fan assembly within the housing of the present invention.

FIG. 3 is a cut away view of the present fan device 10, showing the interior of first housing 12 and second housing 14. In one embodiment, each housing includes a fan assembly 38 which connects to a source of power (not shown) and ultimately switch 26. The reader will appreciate that any number of fan assemblies can be contained within each housing 12, 14 to obtain the optimal airflow to the user. Fan assembly 38 is known in the prior art.

Figure 4:
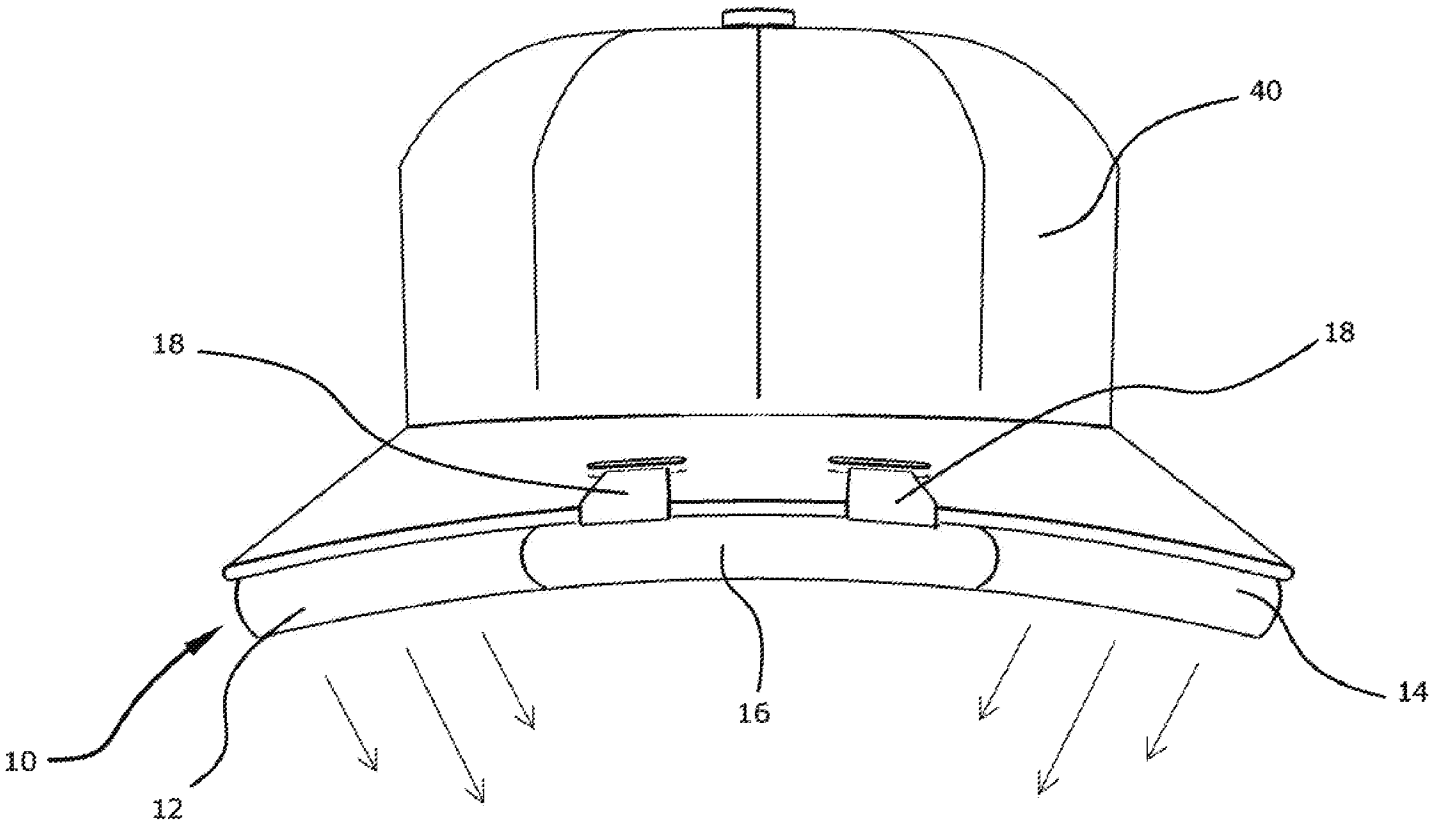
FIG. 4 is a perspective view, showing the present invention attached to a prior art hat.

Fan device 10 is shown attached to a prior art ball cap 40 in FIG. 4. Clips 18 extend from the front of device 10 rearward, allowing device 10 to sit fully underneath the bill of the ball cap 40. First housing 12 and second housing 14 bend slightly downward to fit the curve of ball cap 40. The user can adjust either first housing 12 or second housing 14 further downward as desired. In use, airflow is directed angularly downward towards the user's face (not shown) in the direction of the arrows labeled 'A'. While a ball cap 40 is shown in FIG. 4, any known hat having a bill could be used to mount device 10.

Figure 5:
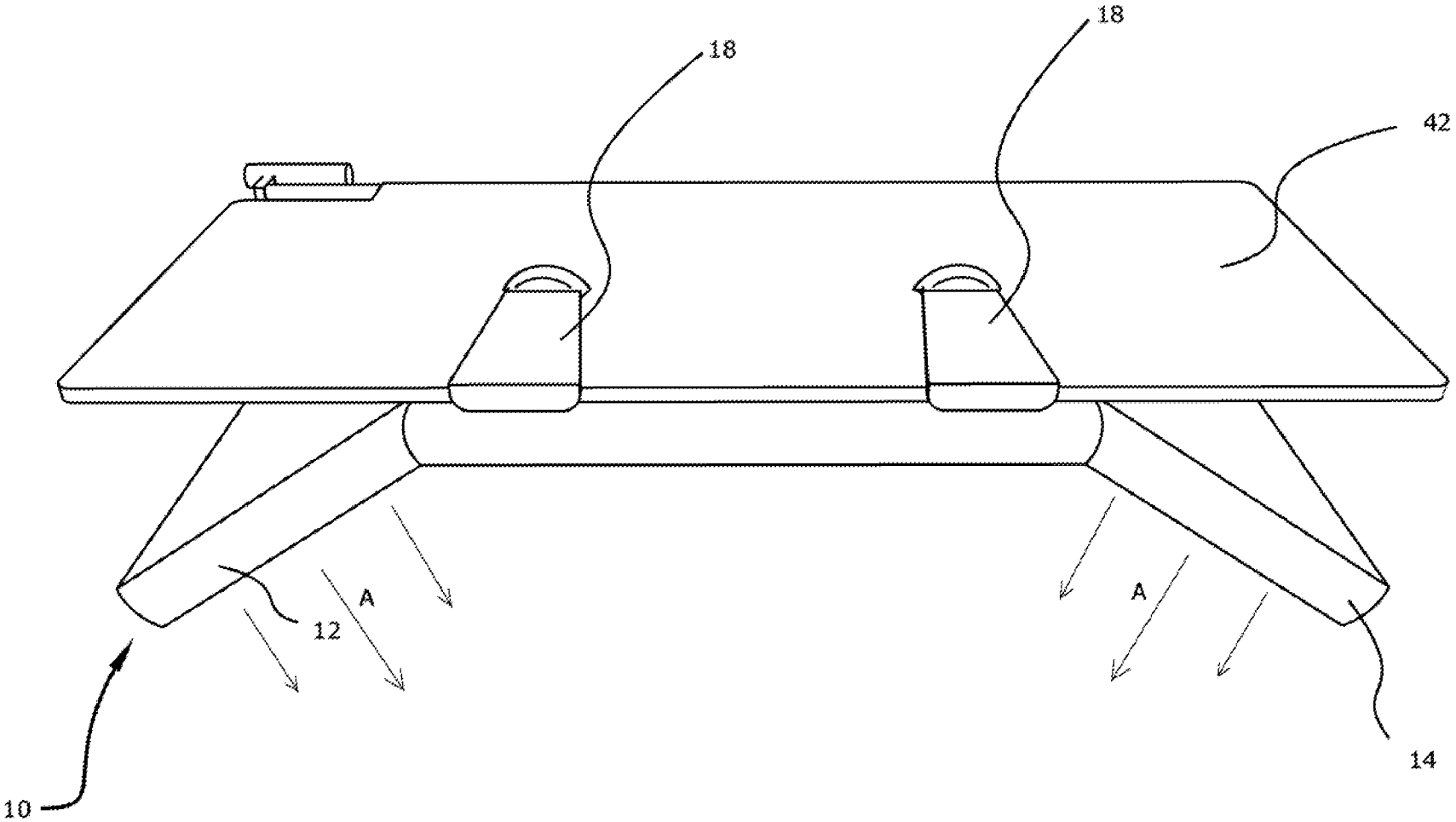
FIG. 5 is a perspective view, showing the present invention attached to a prior art sun visor typically found in an automobile.

Prior art car visor 42 is shown in FIG. 5 with fan device 10 attached thereto. Again, clips 18 are positioned to allow device 10 rest fully underneath visor 42. First housing 12 and second housing 14 can be positioned at any desired angle, such that arrows A are adjusted to provide the most airflow to the user. The device 10 provides a hands-free mechanism allowing user to take advantage of angular air flow. Although car visor 42 and ball cap 40 are shown as objects to which fan device 10 can attach—any known object can be used to mount fan device 10 in a position that is desirable for use.

Figure 6:
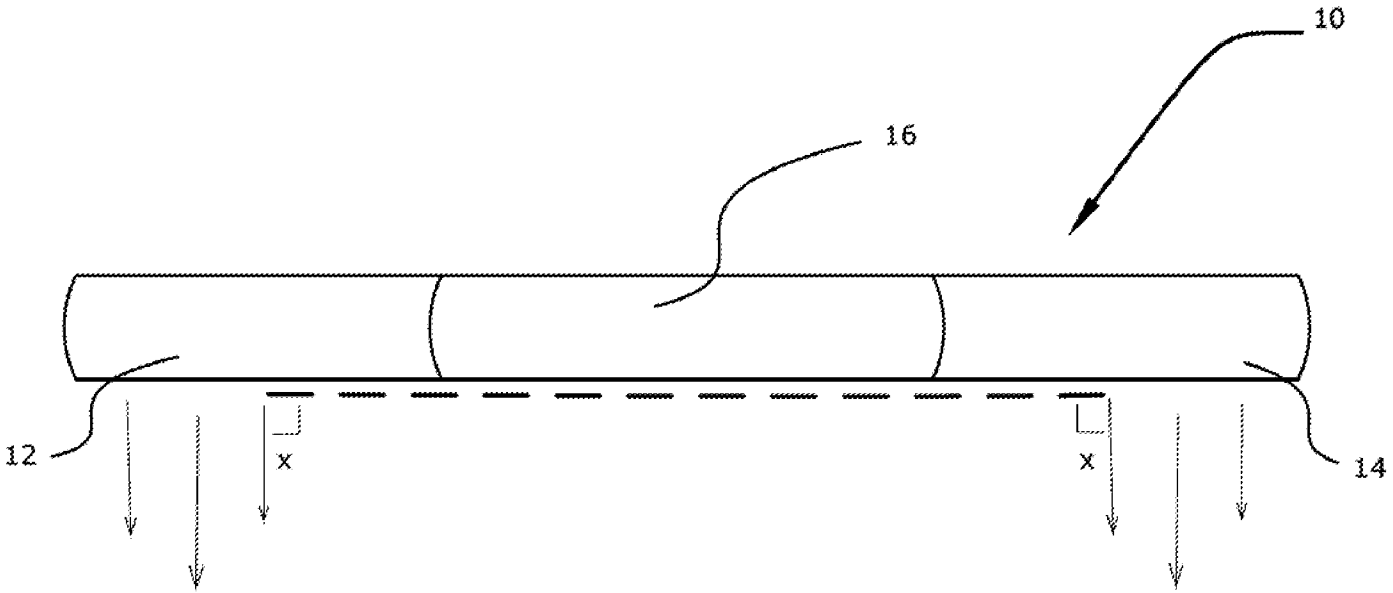
FIG. 6 is a side elevation view, showing the present invention adjusted along a horizontal plane.
Figure 7:
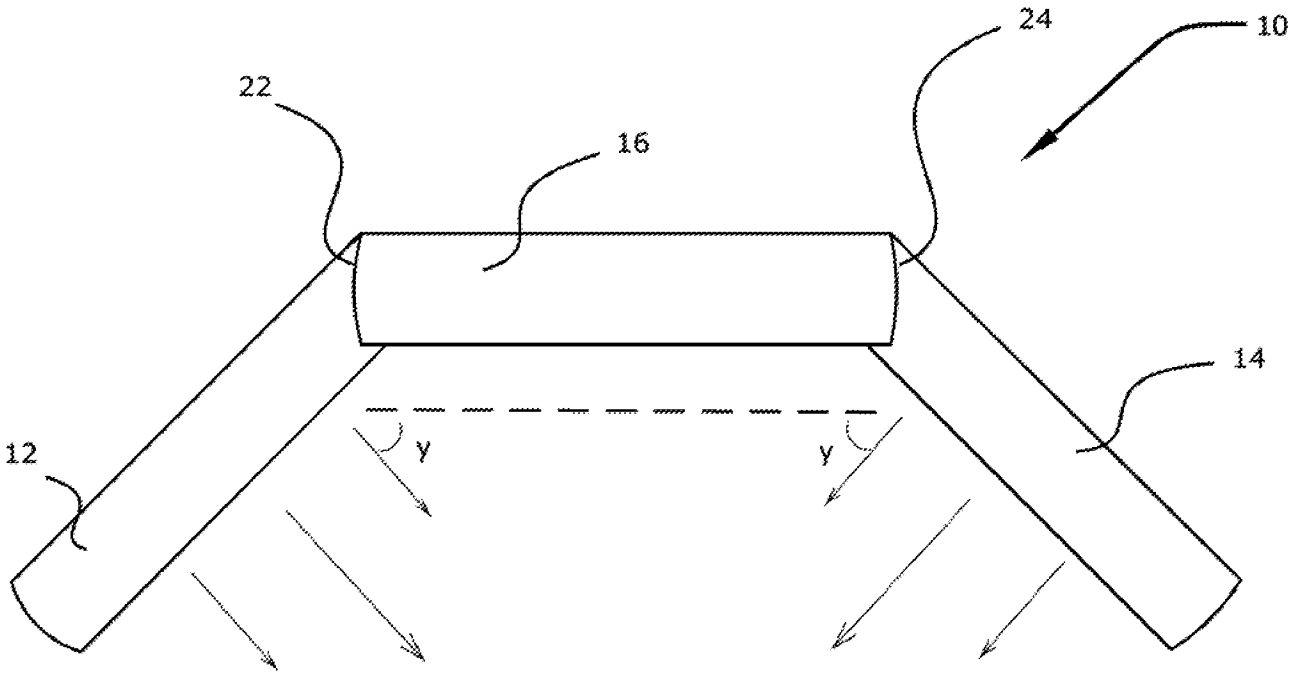
FIG. 7 is a side elevation view, showing the first and second housing on the present invention adjusted 45-degrees from the horizontal plane.
Figure 8:
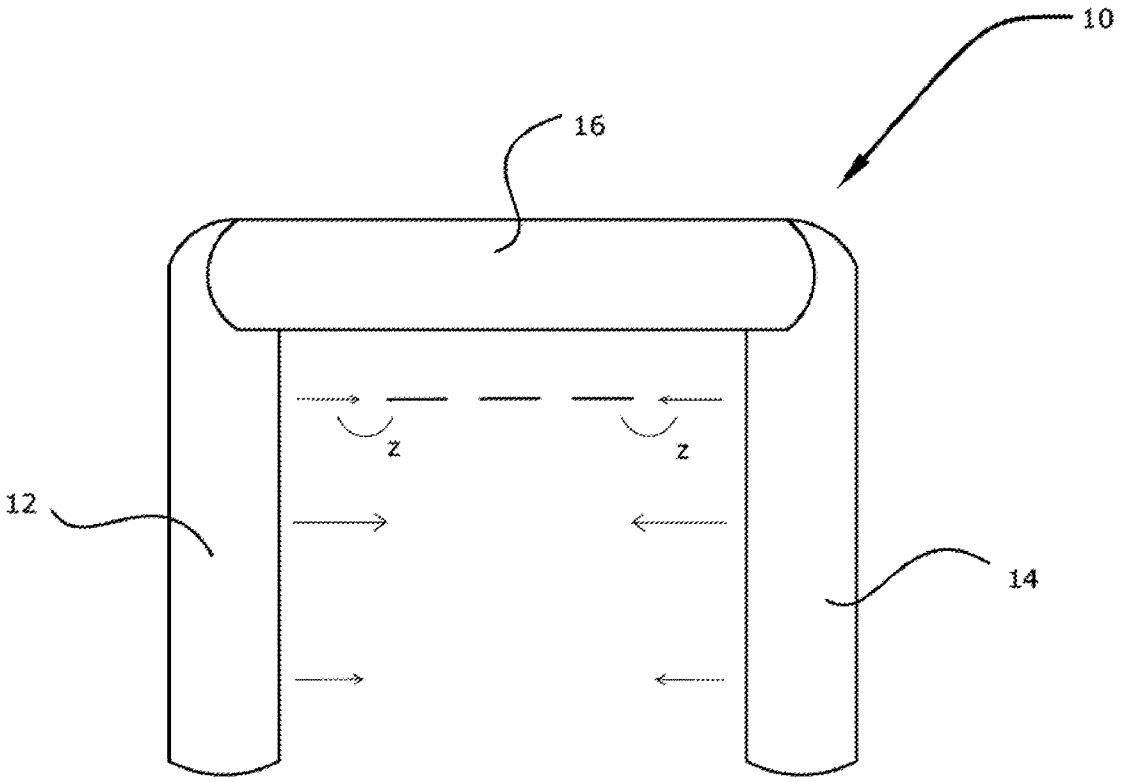
FIG. 8 is a side elevation view, showing the first and second housing on the present invention adjusted 90-degrees from the horizontal plane.
Figure 9:
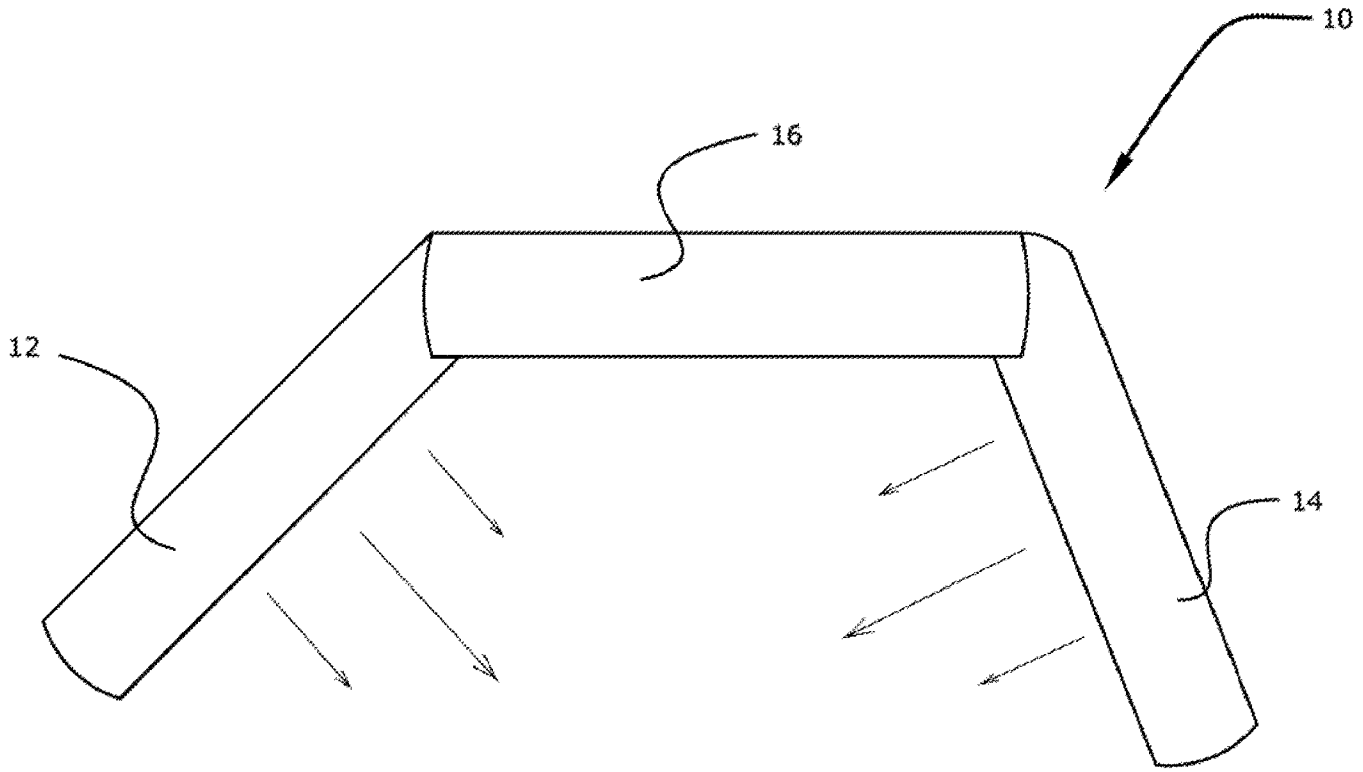
FIG. 9 is a side elevation view, showing the present invention with first housing adjusted independent of second housing.

FIGS. 6-9 are side elevation views illustrating the manner in which the first housing 12 and second housing 14 can be adjusted with respect to the horizontal plane represented by a broken line and aligned with main housing 16. FIG. 6 shows that device 10 can remain along a horizontal plane, such that airflow is directed perpendicularly downward, as illustrated by angle labeled 'X'. In this position, first and second housing 12, 14 remain aligned with main housing 16. FIG. 7 illustrates first housing 12 and second housing 14 adjusted downward at first axis 22 and second axis 24. In this position, airflow is directed at a 45-degree angle downward from the horizontal plane, as represented by the angle labeled y. FIG. 8 shows first housing 12 and second housing 14 adjusted perpendicular with respect to main housing 16. In this position, airflow is in line with the horizontal plane (broken line) or at a 180-degree angle from horizontal plane. Although this position would likely be infrequently utilized, the adjustment is possible. FIG. 9 illustrates that first housing 12 and second housing 14 can be adjusted independent of one another. Thus, airflow coming from first housing 12 may be coming from a different angle than airflow from second housing 14. FIGS. 6-9 illustrate the overall angular displacement that airflow can achieve from the horizontal plane of main housing 16. Specifically, airflow can range from a 90-degree displacement to a 180-degree displacement from the horizontal plane. Each housing unit is preferably as thin as possible while still achieving optimal airflow from device 10.

The preceding description contains significant detail regarding the novel aspects of the present invention. It should not be construed, however, as limiting the scope of the invention but rather as providing illustrations of the preferred embodiments of the invention. As an example, there may be more than one fan assembly 38 in first housing 12 or second housing 14. Additionally, clips 18 may be used as the main attachment mechanism or another known attachment mechanism may be used. Thus, the scope of the invention should be fixed by the following claims, rather than by the examples given.

Having described my invention, I claim:

1. A fan device for attachment to an object, said fan device comprising:

a main housing, having a face, a front edge, a first receiving edge, a second receiving edge and an interior;

a first housing, having an interior, pivotally connected to said first receiving edge of said main housing at a first axis;

a second housing, having an interior, pivotally connected to said second receiving edge of said main housing at a second axis;

wherein said interior of said first housing includes at least one fan assembly;

wherein said interior of said second housing includes at least one fan assembly;

wherein said first housing and said second housing are capable of adjusting downward about said first axis and said second axis; and at least two clips positioned proximate said front edge of said main housing.

2. The fan device as recited in claim 1, wherein said first housing has a top and said second housing has a top, and wherein said device further comprises a hook and loop fastener attached to said top of said first housing and a hook and loop fastener attached to said top of said second housing.

3. A fan device for attachment to an object, said fan device comprising:

a main housing, having a face, a front edge, a first receiving edge, a second receiving edge and an interior;

wherein said main housing is aligned on a horizontal plane;

a first housing, having a face, an interior, pivotally connected to said first receiving edge of said main housing at a first axis;

wherein said first housing is capable of adjusting downward about said first axis from said horizontal plane until said first housing is perpendicular to said horizontal plane;

a second housing, having a face, an interior, pivotally connected to said second receiving edge of said main housing at a second axis;

wherein said second housing is capable of adjusting downward about said second axis from said horizontal plane until said second housing is perpendicular to said horizontal plane;

wherein said interior of said first housing includes at least one fan assembly;

wherein said interior of said second housing includes at least one fan assembly;

wherein said first housing and said second housing include a series of slats to allow airflow to pass; and at least two clips positioned proximate said front edge of said main housing.

4. The fan device as recited in claim 3, wherein said first housing has a top and said second housing has a top, and wherein said device further comprises a hook and loop fastener attached to said top of said first housing and a hook and loop fastener attached to said top of said second housing.

* * * * *